US007536814B2

(12) United States Patent
Ross

(10) Patent No.: US 7,536,814 B2
(45) Date of Patent: May 26, 2009

(54) FRAME SYSTEM

(76) Inventor: Clifford Ross, 264 W. 11th St., New York, NY (US) 10014

( * ) Notice: Subject to any disclaimer, the term of this patent is extended or adjusted under 35 U.S.C. 154(b) by 261 days.

(21) Appl. No.: 11/211,913

(22) Filed: Aug. 24, 2005

(65) Prior Publication Data

US 2007/0062087 A1 Mar. 22, 2007

(51) Int. Cl.
*A47G 1/06* (2006.01)

(52) U.S. Cl. ..... 40/768; 40/700; 40/732; 40/743; 40/772

(58) Field of Classification Search ..... 40/732, 40/700, 718, 743, 768, 772, 769; D6/300; 52/786.11
See application file for complete search history.

(56) References Cited

U.S. PATENT DOCUMENTS

| | | | | | |
|---|---|---|---|---|---|
| 1,041,776 | A * | 10/1912 | Gibson | 40/732 |
| 3,408,759 | A * | 11/1968 | Rotheraine et al. | 40/732 |
| 4,111,425 | A * | 9/1978 | Lathrop | 273/157 R |
| 4,583,309 | A * | 4/1986 | Kane et al. | 40/711 |
| 4,794,714 | A * | 1/1989 | Weisgerber | 40/768 |
| 4,967,499 | A * | 11/1990 | Rosenberg | 40/732 |
| 5,092,063 | A * | 3/1992 | Shultz | 40/759 |
| 5,265,357 | A * | 11/1993 | Yu | 40/714 |
| 5,515,628 | A * | 5/1996 | Rankin | 40/700 |
| 5,524,370 | A * | 6/1996 | Roy | 40/748 |
| 5,640,793 | A * | 6/1997 | Fischer | 40/718 |
| 6,012,245 | A * | 1/2000 | Squitieri | 40/735 |
| D446,657 | S * | 8/2001 | Butler | D6/300 |
| 6,298,593 | B1 * | 10/2001 | Vilims et al. | 40/768 |
| 6,305,112 | B1 * | 10/2001 | Hansen | 40/743 |
| 6,421,942 | B1 | 7/2002 | Galello | |
| 6,427,371 | B2 | 8/2002 | Olson et al. | |
| 6,490,818 | B1 | 12/2002 | Bramhall et al. | |
| 6,510,638 | B1 | 1/2003 | Wang | |
| 6,612,060 | B2 | 9/2003 | Pearce | |
| 6,625,913 | B1 | 9/2003 | Prade | |
| 6,634,127 | B2 | 10/2003 | Bauer | |
| 6,668,477 | B1 | 12/2003 | Cannady | |
| 6,684,545 | B2 * | 2/2004 | Wohlleb | 40/732 |
| 6,694,656 | B2 | 2/2004 | Flodin et al. | |
| D487,639 | S | 3/2004 | Ganz | |
| D491,733 | S | 6/2004 | Manrique | |
| 6,817,125 | B2 | 11/2004 | Chatterjea | |
| 6,820,360 | B2 * | 11/2004 | Glazer | 40/700 |
| D499,890 | S | 12/2004 | Peck | |
| 6,865,836 | B2 | 3/2005 | Sachs-Lavery | |
| 6,868,630 | B2 | 3/2005 | Kim | |
| D504,022 | S | 4/2005 | Rodriguez | |
| D505,017 | S | 5/2005 | Rodriguez | |
| D507,119 | S | 7/2005 | Reeves, Jr. | |
| D509,072 | S | 9/2005 | Babich | |
| 2002/0108285 | A1 * | 8/2002 | Wohlleb | 40/732 |
| 2004/0154205 | A1 * | 8/2004 | Vihos | 40/718 |

* cited by examiner

*Primary Examiner*—Gary C Hoge
(74) *Attorney, Agent, or Firm*—Kenyon & Kenyon LLP

(57) ABSTRACT

A frame for supporting artwork, having a surrounding matt structure having a first stiffener, a second stiffener and a fillet extension, a rectangular tubular grid structure attached to the support, and a plate attached to the rectangular tubular grid structure, wherein the mounting plate is configured to support the artwork.

18 Claims, 4 Drawing Sheets

FRAME SYSTEM

FIELD OF THE INVENTION

The current invention relates to picture frames. More specifically, the current invention provides a frame system with a structural support capable of being used in conjunction with large works of art.

BACKGROUND INFORMATION

Artistic creations, such as drawings, paintings and photographs, are often presented for display by placing the creation in a suitable frame. Often, the artist selects the frame based upon several factors including style, protective capability, and functionality. The styles chosen reflect the individual artist's tastes in order to enhance the overall artwork appearance. Costs of frames vary widely according to the complexity of the frame chosen as well as the materials selected. Frame functionality, however, has generally remained unchanged. Classically, simple wooden frames have been used. In recent years, new advances have been made in the arts in general and in photography in particular, wherein very large scale drawings, paintings and photographs that need protection can now be produced and marketed. These large scale artworks are typically attached to museum board, acrylic sheets, pressboard, or plain aluminum, and then are placed in a frame.

Current frame configurations used for large scale pieces of art, however, have significant limitations. Current frame configurations have a first drawback, wherein the artwork bows, expands and contracts over time due to temperature and humidity, requiring reframing during the lifetime of the artwork. For large-scale artistic works, the movement becomes more pronounced as the size increases.

Wooden frames can also disturb the artwork by accumulating moisture into the wooden frame matrix. Moreover, wood is susceptible to fungus, mold and insects which can also readily negatively impact the artwork. Traditional frames are also limited in the presentation of the artwork. From the viewers perspective, the frame is on the outer surface, a mat is next presented, followed by the artwork. Presentation of the artwork, therefore, is dependent upon this predefined configuration and no capability for differing perspectives are achieved through these classical designs.

There is a need to create a frame which will be capable of supporting and presenting works of art, such as large scale photographs, in a new manner.

There is a further need for a frame system which minimizes sag and other unwanted movement, thereby not detrimentally impacting the artwork framed.

There is still also a further need for a frame which is economical to produce and which is adaptable to support different sized pieces of art.

There is also a need for a frame that functions to diminish common environmental problems, such as pollution, fungus, mold and insects.

There is also a need to provide a frame that allows a work of art to be supported in an aesthetically pleasing manner.

There is a further need to provide a frame that will have a structural system which may be scaled to allow for different sized works of art to be supported by the frame.

SUMMARY

It is therefore an objective of the present invention to provide a frame which will be capable of supporting large artwork, such as large scale photographs.

It is also an objective of the present invention to provide a frame which allows a minimum of sag or other movement, thereby not detrimentally impacting the framed artwork.

It is also an objective of the present invention to provide a frame which is economical to produce and may be adapted to support different sized pieces of art.

It is a still further objective of the present invention to provide a frame that is not susceptible to common environmental problems, such as pollution, fungus, mold and insects.

It is also an objective of the present invention to provide a frame that allows a work of art to be supported in an aesthetically pleasing manner.

It is also an objective of the present invention to provide a frame that will have a structural system which may be scaled to allow for different sized works of art to be supported by the frame.

These and other objectives are achieved by the present invention. The present invention provides a surrounding matt structure for supporting the artwork, glass or acrylic sheet, and outer frame, comprising a support having a first stiffener, a second stiffener and a third stiffener, a rectangular tubular grid attached to the surrounding matt structure having a first stiffener, a second stiffener and a fillet extension, a rectangular tubular grid attached to the support and a mounting plate attached to the rectangular tubular grid, wherein the plate is configured to support the artwork. The present invention also provides other configurations, such as the outside frame further comprising a cover, and an exterior angle connected to the support, the exterior angle configured to bear upon the glass or acrylic face to maintain the cover in a predefined position.

The frame for supporting artwork may also further comprise a gasket, wherein the gasket is positioned between the cover and the support. The gasket may be made of rubber or polyurethane. The cover may be made of glass or molded or formed acrylic materials. The support and the plate may be made of powder coated aluminum.

The frame for supporting artwork can further include a screw block positioned between the support and the exterior angle. The screw block may be made of wood, such as poplar, or plastic. The frame for supporting artwork is also configured such that the exterior angle is attached to the nail block through screws. The frame may further be configured such that the first stiffener, the second stiffener and the third stiffener are open box structures. The frame may also be configured such that the gasket, the support, the box structure, the plate and the cover form a sealed volume and wherein the sealed volume also has an arrangement to measure humidity and remove water vapor present in the sealed volume.

The invention specifically provides for an exemplary embodiment of a frame for supporting artwork, comprising a matt support having a first stiffener, a second stiffener and a fillet extension, a rectangular tubular grid attached to the support; and a mounting plate attached to the rectangular tubular grid wherein the mounting plate is configured to support the artwork.

DETAILED DESCRIPTION

Figure 1:
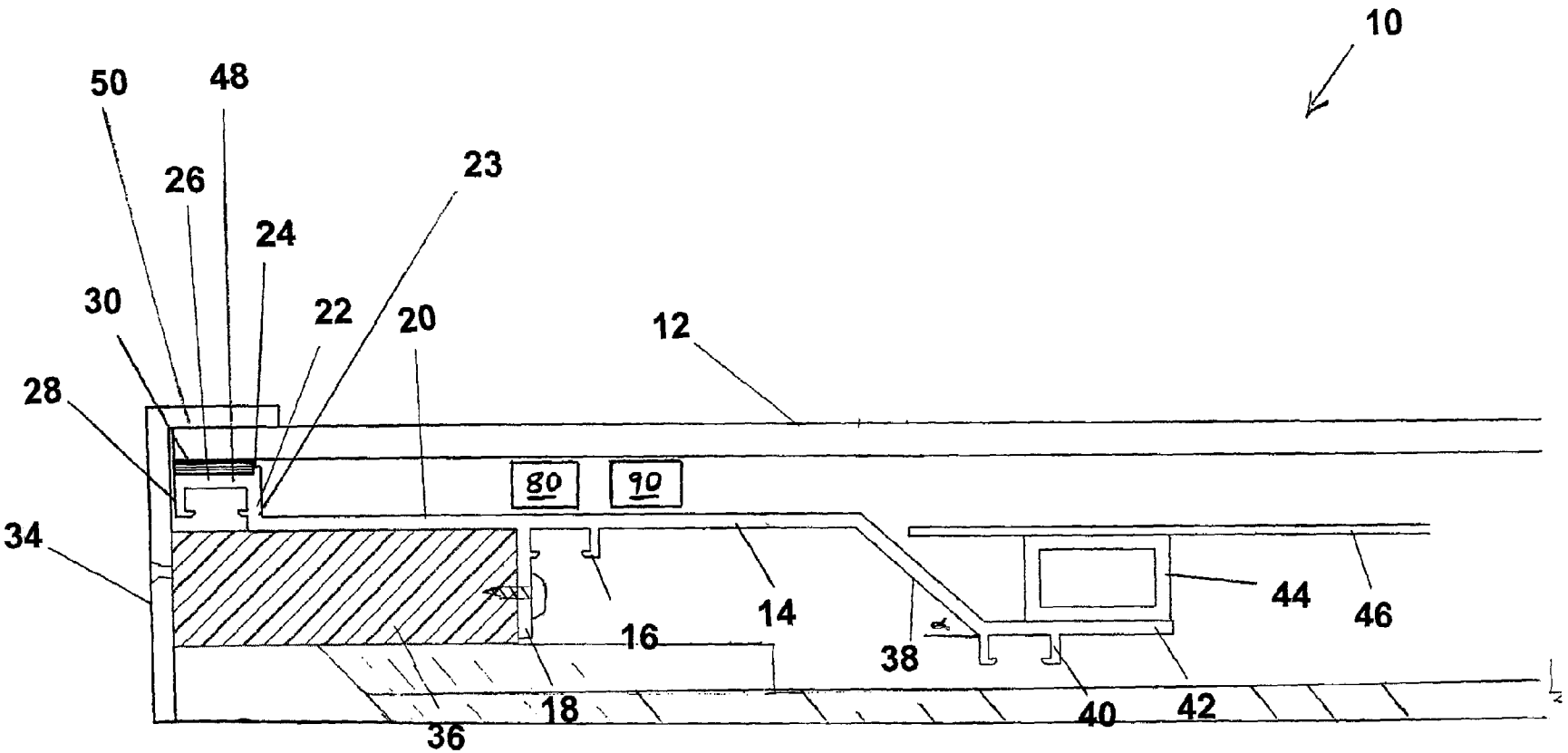
FIG. 1 presents a cross-sectional view of a frame in accordance with the current invention.

FIG. 1 presents a frame 10 in accordance with the present invention. The frame 10 provides an arrangement which will structurally support a work of art, for example a large photograph, such that individuals may view the art in a hanging (vertical) position. The frame 10 is comprised of a support 14 which extends around the periphery of the work of art. The support 10 is enveloped on its sides by an angle 34 which keeps a cover 12 installed over a face of the work of art.

As illustrated, the support 14 is configured in a complex shape wherein from a first end 42, the support 14 extends to a first stiffener 40. The first end 42 ends in alignment with a section of the rectangular tubular support grid 44. The first end 42 may be a square cut-off section, as illustrated, or may be a rounded-off section. The first stiffener 40 extends from the cantilevered section of the first end 42 to allow for bending capacity of the overall frame 10. The support 14 further extends from the first stiffener 40 through extension 38 placed at angle $\alpha$, illustrated at approximately 42 degrees. Although angle $\alpha$ is illustrated as 42 degrees, angle $\alpha$ can extend from zero to ninety degrees, thereby providing a desired offset depth for the placement of artwork upon the plate 46. Additionally, the length of extension 38 may be increased or decreased according to the desired offset. The support 14 further continues from the extension 38 to a second stiffener 16. In the illustrated embodiment, the second stiffener 16 is positioned approximately midway between the first end 42 and the exterior angle 34, however other configurations are possible. The second stiffener 16 further allows the support 14 to withstand anticipated structural loading from the supported artwork. The second stiffener 16 is illustrated as a box section with an open back. Although illustrated in the present invention as an open box back unit, other configurations are possible and as such these configurations are to be considered as part of the invention. The other non-limiting configurations for second stiffener 16 include a beam shape, a half beam shape, a full box shape, a tube shape. The second stiffener 16 is located along a different horizontal plane from the first stiffener 40 to increase shear, bending and torsional capacity of the support 14. A further screw block extension 18 extends from the second stiffener 16 to form a space such that a screw block 36 may be inserted between the screw block extension 18 and the exterior angle 34. From the screw block extension 18, the support 14 extends through a connecting piece 20 to a fillet extension 22. In the illustrated embodiment, the fillet extension 22 is connected to the remainder of the support 14 through an offset piece 23. The fillet extension 22 is illustrated as an open box section. Other non-limiting configurations for fillet extension 22 include a full box shape.

A gasket 30 is provided on the front face 48 of the fillet extension 22. The gasket 30 is made of any rubber or silicone based material to allow for contact between the front cover 12 and the support 14. The gasket 30 may be made, as a non-limiting exemplary embodiment, of EPDM, rubber, silicone caulk or other similar material to provide a tight seal between the support 14 and the cover 12. The gasket 30 is provided around the whole external periphery of the cover 12 to allow the work of art to be supported in an air-tight confined space. As the gasket 30 is used to provide an air-tight confined space, the space may be filed with a desired gas to eliminate or substantially reduce the amount of deterioration that the work of art will experience. A non-limiting example of the present invention would be to provide an injection port in the side of the exterior angle 34 such that nitrogen or another non-damaging gas or atmosphere can be injected past the gasket 30 into the defined air-tight confined space. The injection port can be self sealing, thereby providing the capability to add or subtract the amount of atmosphere from the air-tight confined space. A thin rubber material or other similar material may be used as a gasket.

The gasket 30 is also configured in the illustrated embodiment to be countersunk into the support 14 such that the gasket 30 is not viewable by an observer on the cover 12 side of the frame 10.

The air-tight confined space defined by the gasket 30, the cover 12, and the support 14 as well as the rectangular tubular grid section 44 and the mounting plate 46 can be measured through the use of a humidity measurement device 80, shown schematically in FIG. 1, positioned to maintain a desired amount of humidity in the space. A thermohygrometer may also be used to keep the humidity measurement device accurate over extended use times. An arrangement 90, shown schematically in FIG. 1, may also be provided inside the space such that material, such as a desiccant, silica gel, or other material to maintain humidity at a desired level is incorporated into the space.

A cover 12 is optionally incorporated onto the front of the frame 10. The cover 12 provides a tight seal for the enclosed artwork. The cover 12 extends over the entire front panel section of the frame 10 to ensure that exterior environmental conditions do not harm the artwork. The cover 12 may protect against damage by filtering between 95 and 97 percent of ultraviolet rays which attempt to pass through the cover 12. More or less protection of ultraviolet rays may be provided by the cover 12. The cover 12 may also filter infra-red rays or other detrimental spectrums as needed. The cover 12 may be made of glass, as in the illustrated exemplary embodiment. Other configurations, such as those using molded or formed acrylic materials, may also be used. The thickness of the cover 12 is chosen to provide a non-damaging viewport onto the artwork, therefore the cover 12 is provided with a thickness that minimizes the amount of flexing over the entire span. The cover 12 may also be configured such that the cover 12 is shatterproof, thereby providing an added layer of protection for the artwork.

An external angle 34 is provided to interface with the cover 12 and the screw block 36. The external angle 34 is provided to flushly fit against the cover 12 along a predefined edge 50. The predefined edge 50 length in the exemplary embodiment provides a greater length than that of the overall gasket 30 length. The predefined length, however, may be equal to or smaller than, the length of the gasket 30. The external angle 34 continues around the corner of the frame 10 and down the side of the frame 10 to buttress against the screw block 36. At least one hole is provided in the external angle 34 to allow a screw, nail or other connector to be inserted into the block 36. Additionally, the nail block 36 may be glued into place to provide a connection which extends around the periphery of a majority of the block 36. The length of the external angle 34 determines the overall depth of the frame 10. The frame 10 may be sealed on a reverse side by material placed underneath the support 14. The material placement may also allow the internally supported members to remain in an unsealed condition.

Figure 2:
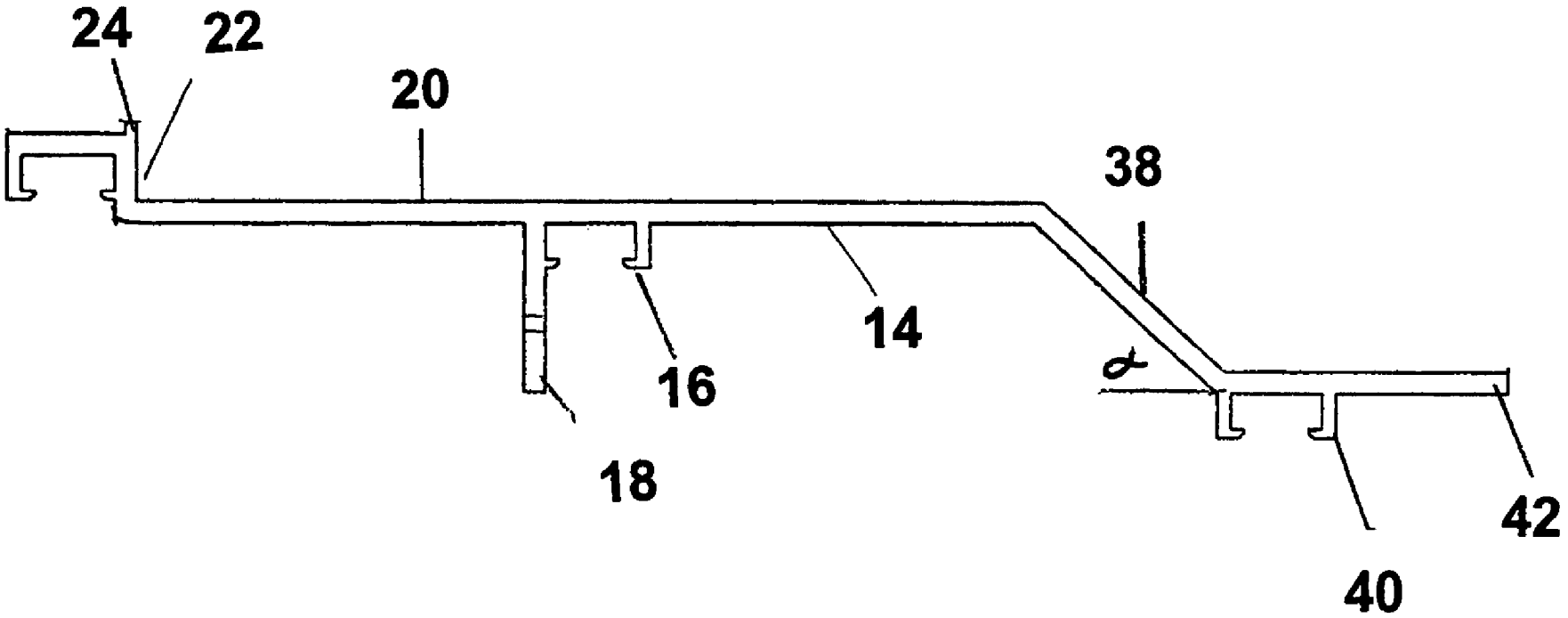
FIG. 2 presents a partial cross-sectional view of the frame of FIG. 1.

Referring to FIG. 2, the frame 14 is illustrated without a screw block 36, external angle 34, gasket 30 or cover 12. The frame 14 is made of a powder coated aluminum. The mounting plate can be is made of white powder coated aluminum to enhance the reflectivity of the surface and therefore enhance the visual contrast of translucent materials such as photographic paper. The frame 14 may be made of other materials, such as plastic, acrylic and non-corrosive metals as non-limiting examples.

As illustrated in FIG. 2, the second stiffener 16 and the first stiffener 40 may be multi-component structures to provide structural support to the overall frame.

Figure 3:
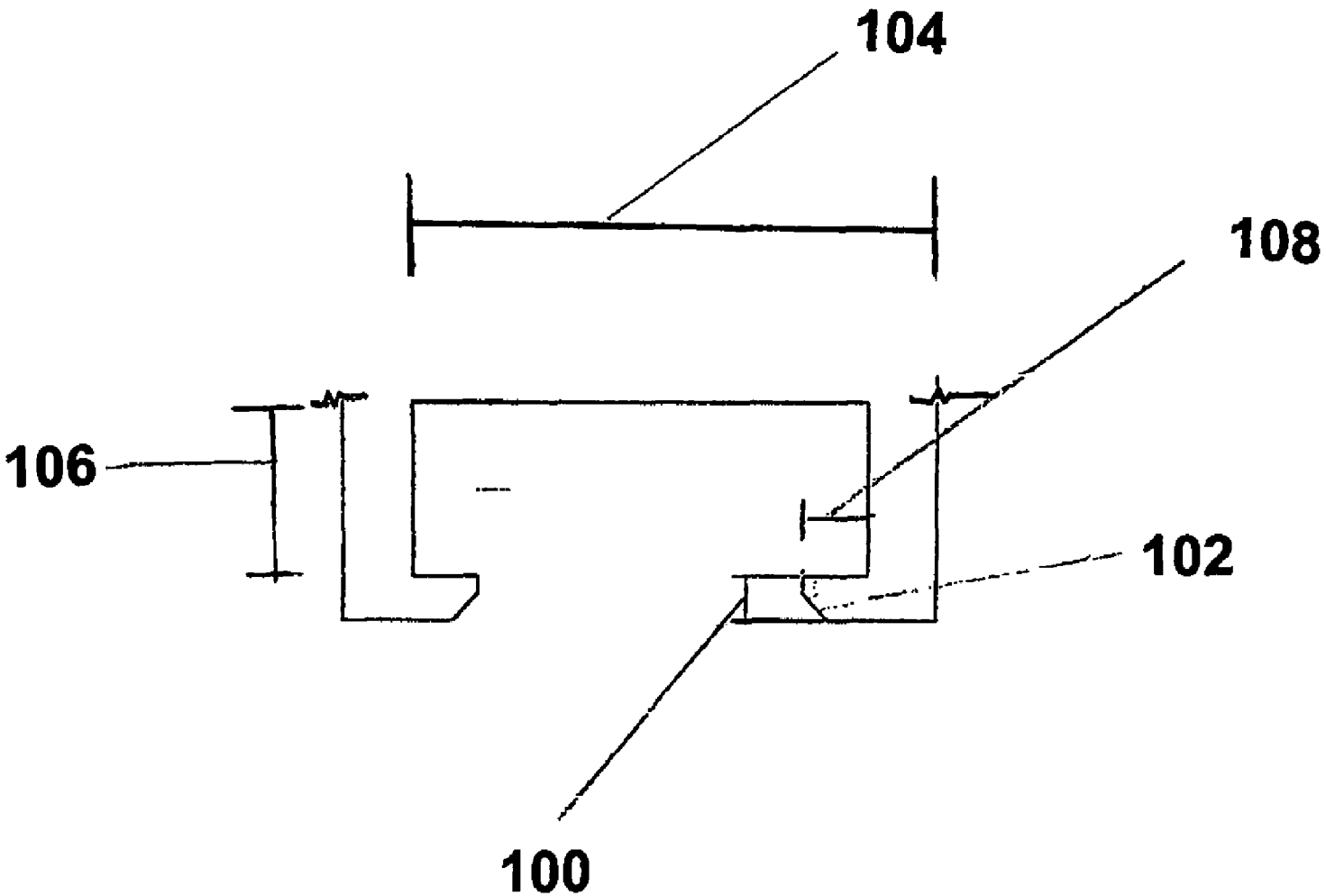
FIG. 3 is a cross-sectional view of a stiffener.

Referring to FIG. 3, the dimensions of the individual box structures of the first support 40, and second support 16 are illustrated. Each of the first support 40, and second support 16 may have the same configuration as illustrated in FIG. 3. The inside depth 106 of the open box structure, as illustrated in FIG. 3, provides a depth of approximately 0.020 inches (0.05 cm). The flange depth 102 of each individual flange is approximately 0.05 inches (0.127 cm). The bottom flange extension 108 is configured in the illustrated embodiment to be approximately 0.075 inches (0.1905 cm). The inside length 104 of the open box structure is approximately 0.525 inches (1.33 cm). The inside depth 106, the flange depth 102, the bottom flange extension 108 and the inside length 104 are all illustrated as exemplary embodiments only. Other dimensions for these features may be used to increase or decrease the amount of structural support provided.

The present invention provides a carefully designed system that successfully displays large works of art, such as large photographs. The frame 10 allows archival standards for the works of art framed. The frame 10 is scalable in nature, therefore larger or smaller versions of frames 10 may be used.

The present invention provides advantages over wooden framing systems. The present invention allows artwork to be supported in an aesthetically pleasing way. The present invention further provides a configuration which minimizes the accumulation of moisture near the artwork. The present invention also provides a configuration which minimizes the sag or movement of the artwork. The present invention also eliminates the detrimental effects of pollution, fungus, mold and insects which can affect the artwork. The present invention further allows the artwork to be supported in a configuration that is unusual to the observer, thereby drawing attention to the framed artwork.

Figure 4:
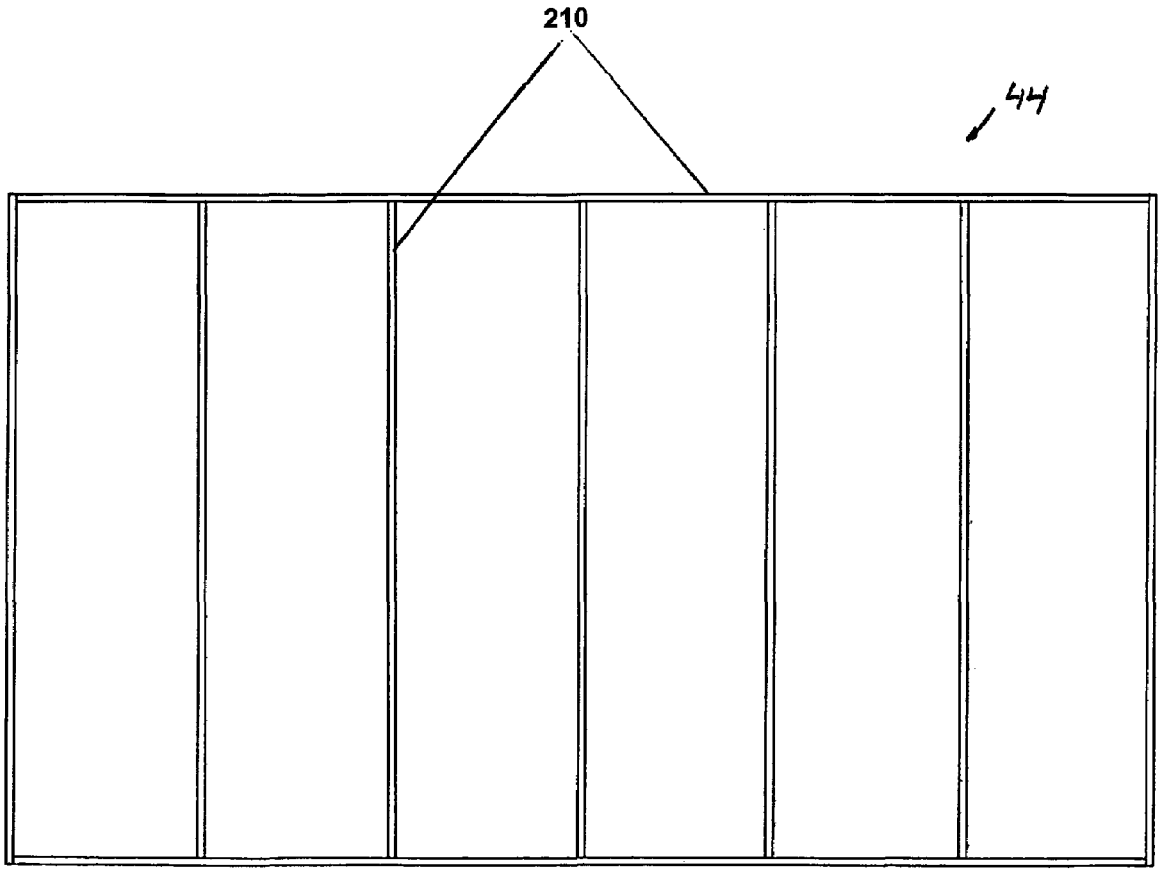
FIG. 4 is a top view of a rectangular tube grid section.

Referring to FIG. 4, a rectangular tubular grid structure 44 is presented. The rectangular tubular grid structure 44 is connected to the remainder of the frame 10 through a connection arrangement such as a hole, keyway or other similar connection. Although illustrated as having nine individual tubular supports 210, alternative numbers of supports may be used. The rectangular tubular grid structure 44 provides a structural support for the overall frame 10.

In the foregoing specification, the invention has been described with reference to a specific exemplary embodiment thereof. It will, however, be evident that various modifications and changes may be made thereunto without departing from the broader spirit and scope of the invention as set forth in the claims. The specification and drawings are accordingly to be regarded as in an illustrative rather than a restrictive sense.

What is claimed is:

1. A frame for supporting artwork, comprising:

a mat support having a first stiffener, a second stiffener and a fillet extension;

a rectangular tubular grid structure attached to the support;

a mounting plate attached to the rectangular tubular grid structure wherein the mounting plate is configured to support the artwork;

a cover;

an exterior angle connected to the support, the exterior angle configured to bear upon the cover to maintain the cover in a predefined position; and a gasket, the gasket positioned between the cover and the support, wherein the gasket, the mat support, the rectangular tubular grid structure, the mounting plate and the cover form a sealed volume.

2. The frame for supporting artwork according to claim 1, wherein the gasket is made of rubber.

3. The frame for supporting artwork according to claim 1, wherein the support is made of a rigid material.

4. The frame for supporting artwork according to claim 1, wherein the gasket is a polyurethane material.

5. The frame for supporting artwork according to claim 1, wherein the cover is made of glass.

6. The frame for supporting artwork according to claim 1, wherein the cover is made of acrylic materials.

7. The frame for supporting artwork according to claim 1, wherein at least one of the support and the plate are made of powder coated aluminum.

8. The frame for supporting artwork according to claim 1, further comprising:

a screw block positioned between the support and the exterior angle.

9. The frame for supporting artwork according to claim 8, wherein the exterior angle is configured such that the angle is attached to the screw block through screws.

10. The frame for supporting artwork according to claim 8, wherein the screw block is made of poplar.

11. The frame for supporting artwork according to claim 8, wherein the screw block is made of plastic.

12. The frame for supporting artwork according to claim 1, wherein the first stiffener, the second stiffener and the fillet extension are open box structures.

13. The frame for supporting artwork according to claim 1, wherein the mounting plate is connected to the rectangular tubular grid structure through one of gluing, welding and screwing.

14. The frame for supporting artwork according to claim 1, wherein the sealed volume has an arrangement to measure humidity.

15. The frame for supporting artwork according to claim 1, wherein the sealed volume has an arrangement configured to remove water vapor present in the sealed volume.

16. The frame for supporting artwork according to claim 1, wherein the gasket is countersunk into the third support.

17. The frame for supporting artwork according to claim 16, wherein the support is configured to extend at an angle of approximately 42 degrees along at least a length of the support.

18. The frame for supporting artwork according to claim 1, wherein the mat support is made of one of plastic and acrylic.

* * * * *